US008936054B2

(12) United States Patent
Pelc, Jr.

(10) Patent No.: US 8,936,054 B2
(45) Date of Patent: Jan. 20, 2015

(54) ELONGATED CAM, SELF-LOCKING, BOARD STRAIGHTENING DEVICE

(75) Inventor: Robert J. Pelc, Jr., Bradenton, FL (US)

(73) Assignee: The IPE Clip Fastener Co. LLC

( * ) Notice: Subject to any disclaimer, the term of this patent is extended or adjusted under 35 U.S.C. 154(b) by 846 days.

(21) Appl. No.: 12/687,373

(22) Filed: Jan. 14, 2010

(65) Prior Publication Data

US 2010/0180986 A1 Jul. 22, 2010

Related U.S. Application Data

(60) Provisional application No. 61/145,265, filed on Jan. 16, 2009.

(51) Int. Cl.

| | |
|---|---|
| ***B27H 1/00*** | (2006.01) |
| ***B25B 5/08*** | (2006.01) |
| ***E04F 21/22*** | (2006.01) |

(52) U.S. Cl.
CPC .. *B25B 5/08* (2013.01); *E04F 21/22* (2013.01)
USPC ..... 144/269; 144/270

(58) Field of Classification Search
USPC ..... 144/269, 270; 254/11–17; 269/208, 269
See application file for complete search history.

(56) References Cited

U.S. PATENT DOCUMENTS

| | | | | |
|---|---|---|---|---|
| 10,061 | A | | 9/1853 | Parrish |
| 77,610 | A | | 5/1868 | Hall |
| 144,140 | A | | 10/1873 | Reed |
| 164,145 | A | | 6/1875 | Clark |
| 371,169 | A | | 10/1887 | Brown |
| 495,446 | A | | 4/1893 | Woolcocks |
| 608,458 | A | * | 8/1898 | Ingersoll ..... 254/16 |
| 618,573 | A | * | 1/1899 | Ingersoll ..... 254/16 |
| 832,516 | A | | 10/1906 | Williams |
| 2,552,519 | A | | 5/1951 | Clair |
| 2,585,013 | A | | 2/1952 | Johnson |
| 4,493,477 | A | | 1/1985 | Greer |
| 4,621,791 | A | | 11/1986 | Staskiewicz et al. |
| 4,821,784 | A | | 4/1989 | Cone |
| 5,139,231 | A | | 8/1992 | Temple |
| 5,248,127 | A | | 9/1993 | Young |
| 5,269,494 | A | | 12/1993 | Pittman |
| D353,987 | S | | 1/1995 | Pasto |
| 5,478,050 | A | | 12/1995 | Ott |
| 5,527,014 | A | * | 6/1996 | Bracewell ..... 254/15 |
| 5,605,319 | A | | 2/1997 | Reiley |
| 5,826,858 | A | | 10/1998 | Gordon |
| 2005/0247019 | A1 | | 11/2005 | Pasto |

OTHER PUBLICATIONS

Web Site: www.cepcotool.com; see BoWrench.

* cited by examiner

*Primary Examiner* — Shelley Self
*Assistant Examiner* — Onekki Jolly
(74) *Attorney, Agent, or Firm* — Patricia M. Costanzo

(57) ABSTRACT

A board straightening tool able to provide the force to straighten bent boards by simultaneously maintaining a grasping connection to both the joist being used to support the straightening device and the board being fastened to that joist, and maintaining a clearance between the straightening tool and board for the use of an Install the fastening device on the same joist that the tool is using for support is required to obtain the straightest installed boards possible and to maintain the maximum straightness of the deck board after the straightening device is released. The grasping pins are constructed either from a knurled metal for more grasp power or have a smooth surface providing for a reduction of marring of the joist. The tool also provides the force required to maintain consistently spaced gaps between the boards for a more desirable appearance.

64 Claims, 10 Drawing Sheets

20

20 current locking dog slot example for moving dowels (locking fingers)

current preferred multi radius design examples of various multi radius cam design

ELONGATED CAM, SELF-LOCKING, BOARD STRAIGHTENING DEVICE

CROSS-REFERENCE TO RELATED APPLICATIONS

This Application claims the benefit of U.S. Provisional Application No. 61/145,265, filed Jan. 16, 2009.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

FIELD OF INVENTION

The present invention relates generally to woodworking tools and, more particularly, to a board straightening tool that enables a single installer to simultaneously straighten and position each board that is being installed, and to maintain a clearance required by edge-mount fasteners, alternatively, the tool enables a single installer to bend a board into a curved shaped to achieve a decorative curved pattern.

BACKGROUND

The background information discussed below is presented to better illustrate the novelty and usefulness of the present invention. This background information is not admitted prior art.

More and more frequently the lumber that is used to make for framing, decking, and fencing is harvested from fast-growing, young trees. In general, lumber garnered from young trees is less stable than old-growth tree lumber and produces boards that tend to be crooked, bowed, or twisted and must be straightened before they can be used.

SUMMARY

The straightening device tools made according to the principles of the present invention provide the force required for a single installer to straighten bent or crooked boards, including very hard boards. Each tool simultaneously maintains a grasping connection to both the joist being used to support the tool and to the board being fastened to the joist. Additionally, and importantly, each tool maintains a clearance between itself and the board being fastened to the joists so that an edge-mount board-fastener can be used to provide for an installation to be completed by a single installer. The clearance is also necessary for an installer to install the board-fastener on the same joist that is supporting the tool in order to obtain the straightest possible installed boards and, importantly, to maintain the maximum straightness of the deck board after the straightening device is released.

The principles of the present invention were conceived when the Inventor realized that what he had to work with are the currently available deck boards milled almost exclusively from fast growing juvenile wood culled from the second- and third-growth trees and, thus, are inherently less dimensionally and linearly stable resulting in boards that remain straight only as long as they remain wet, but upon drying are likely to shrink and/or swell. The Inventor recognized that the warping of the young wood creates problems, for him and for all others who must use this wood. Although drying the wood, using either air drying or kiln drying, eliminates, or at least significantly reduces, much of the young wood warping, the drying process substantially increases the time and, in many cases—the energy costs, thus, increasing the cost of the lumber. Moreover, kiln drying processes create "drying stresses" on the boards being dried causing boards that were straight when originally cut to become bent and crooked upon the rapid heat induced drying. As kiln dried wood is widely used in the building industry, there is a considerable increase in the total cost of lumber, so produced, due to the extreme force required to straighten boards bent by the kiln drying process. For reasons, such as these, the use of un-dried, young, green wood continuously increases. Not only is young, green wood initially less expensive than dried young wood or more mature wood, it also accepts nails easier than older, stronger wood. Green wood, however, because it is rarely perfectly straight requires straightening before, or during, installation in order to achieve a quality installation that includes consistent spacing between each pair of adjacent floor boards, in addition to straight and true pattern alignments. Moreover, there has been an increased use of imported tropical woods by both residential and commercial industries. Although tropical timbers have drastically greater bending and resistance/strength than traditional pressure treated pine boards, today's tropical lumber often arrives bent and with many of the same imperfections of non-tropical wood. The increased strength of tropical wood requires an increased force from board straightening devices in order to straighten the tropical wood deck boards during installation. The present Inventor recognized that existing board straightening devices are not able to apply the required directional force required to straighten a board because they are not able to, simultaneously, grasp the joist to which the board is being attached and provide adequate pushing, straightening leverage on the board being straightened without slipping. Moreover, the thickness of framing joists can vary significantly depending on such factors as their source and the size needed to provide the strength required for a particular purpose. However, while some currently available devices are simply unable to adjust for thickness, others must rely upon additional, and rather clumsy, attachments to accommodate different thicknesses. Such devices preclude the use of an edge-mount fastener on the same joist that is being straightened, which reduces the ability of the fastener to hold the board at maximum straightness after the straightening device of the present invention is released. In fact, there is no tool available that is able to provide all of the advantages provided by the present tool. It is important to note that these advantages do not rely on the combination of old elements according to their established functions to achieve a desired effect. These advantages were obtained by a unique design of the tool itself, as will be explained in detail below. The kinds of innovative engineering decisions used in the deliberations that had to be made to achieve the effects sought are not within the level of ordinarily skilled artisans.

The present inventor recognized the disadvantages and shortcomings of currently available board straightening devices and determined that these deficiencies are due to their design mechanics. Moreover, the Inventor experienced use of presently available tools often results in damage to or marring of the structural joist that they are leveraged on, damage of or marring to the deck board being straightened, an inability to apply the force required to straighten the crooked boards, and/or the tools slipping away from the desired direction of force as they lack the necessary mechanical engineering to provide a rigid enough hold onto the joist that is being used to apply leverage force. Presently available tools were designed when easily bent (i.e., straightened) softwood decking was the norm, and, thus, traditional face-mounted fasteners do not require a clearance space between the straightening device and the edge of the board, as does the installation of recently invented edge-mount fasteners that are quickly becoming the norm in modern board fastening.

The present Inventor realized the increasing use of edge-mount fasteners, for example his Ipe Clip® brand edge-mount hidden deck fasteners, as well as others, is increasing the need for a straightening tool that provides space between itself and the board being straightened and installed to enable the installation of an edge-mount fastener. And, additionally to provide a higher than typically available force against the hard tropical hardwood deck boards in order to have the board held straight while the edge-mount fastener is installed between the straightening device and the deck board. Accordingly, the Inventor conceived and created a cost-effective straightening tool that provides space between the tool and the board to enable the installation of the edge-mount fastener to provide greater straightening force that is presently available, and thus to provide for one man operation of the tool (i.e., providing a single installer the ability to straighten a deck board while keeping their hands free in order to install and lock in place, for example, an edge-mount fastener, such as the Ipe Clip® hidden deck fastener). A tool made according to the principles of the present invention, also provides the force required to maintain a consistently spaced gap between the adjacent boards for a more desirable appearance. The adjustable grasping pins (locking fingers) according to the principles of the present invention provide for a unique built-in adjustability to accommodate varying joist sizes and allow for boards to be straightened regardless of whether they are perpendicular or at an angle to the joist. The adjustable pins are also offered in a knurled metal providing for the tool to grasp onto the joist more firmly, and, thus enabling an increase the amount of bending force that can be applied, alternatively the pins may be provided as smooth pins to reduce marring of joist where the ascetics of the framing structure is exposed.

The tool, according to the principles of the present invention, is herein described in its use for straightening and installing wooden deck boards, but can also be used on composite, plastic, and tongue and groove decking, as well as on plywood sub-floors, sheet goods, and wall and ceiling applications.

Other board straightening tools cannot limit the "throw" past the maximum holding spot, i.e., sweet spot. This slows the installation and frequently requires repeatedly moving the handle back and forth to locate the maximum force location of the tool. The present invention overcomes such a deficiency by providing for an offset oblong shaped cam having a uniquely shaped perimeter of various lengths and arcs of curves and straight sections that eliminates the need for the installer to push the tool lever past the point of maximum force exertion, which occurs when currently available devices are used. Many of the presently available devices attempt to overcome such design shortcomings by clamping their tool against the joist but, because of the tool design, this can damage the joist and/or the edge of the deck board that the tool is attempting to straighten. The clamping tool method often results in an undesirable slower method, and/or mechanical slippage on the joist by improper holding capacity. Additionally, many of the currently available devices are not able to be locked in place. Those tools that do self-lock to the board being installed either cause significant joist/board damage or apply inadequate pressure to straighten the board being installed. The device, as taught herein, severely limits the physics of being able to push past the sweet spot, thus saving labor and time. The unique cam design of the present invention overcomes such problems by increasing the scissor-like compression against the joist to allow for maximum holding pressure and a reduction of slippage of the tool on the joist, therefore allowing for maximum force to be applied to the board being straightened.

All of the above described benefits and innovations are made possible by providing for a straightening tool made according to the principles of the present invention that comprises a handle non-rotably attached to a key-shaped cam, the key-shaped cam having a perimeter of various lengths of arc and various lengths of straight sections and being rotatably attached to a locking dog, the locking dog having grasping pins extending from an opposing surface, the handle, the cam, the locking dog, and the grasping pins so arranged to increase the scissors-like compression of the tool against the joist to allow for maximum holding pressure and a reduction of slippage of the tool on the joist.

The principles of the present invention also provide a board straightening tool constructed of a handle attached to a cam, the cam attached to a locking dog, the locking dog having grasping pins extending from an opposing surface, the handle, the cam, the locking dog, and the grasping pins so arranged for the tool to simultaneously maintain a grasping connection to both the joist being used to support the straightening device and the board being fastened to that joist and to maintain a clearance between the board and straightening tool for the installation of an edge-mount board fastener providing for a single installer to simultaneously straighten and install a board to a joist.

The invention principles further comprise the handle detachably and non-rotably attached to the cam, wherein the handle is able to be detached and reattached in a non-rotatable attachment to be used in 180 degree directionally opposition positions, and wherein the handle is adjustable to be positioned for use in multiple varying degrees from the tool body.

The invention principles further comprise the cam having a curved perimeter section adjacent a straight perimeter section providing for the straight perimeter section to keeping the tool from slipping past the spot of greatest application of force by the tool, furthermore the cam further comprising a uniquely shaped perimeter of various lengths and arcs of curves and straight sections, and the cam having an offset rotable attachment to a locking dog.

The invention principles still further comprise the grasping pins being positionably adjusted to grasp varying joist sizes to stabilize the locking dog so that when the rounded perimeter part of the cam is wedged against the board the offset rotable attachment acts as a fulcrum to multiply the force that an installer applies to the handle. If desired, the grasping pins may be constructed from a knurled metal for a tighter hold made possible by a surface of greater friction, or being made with a smooth surface providing for a reduction of marring of the joist.

The invention principles further comprise a board straightening tool constructed of a handle fixedly, detachably, and non-rotably attached to a cam, the cam having a curved perimeter section adjacent a straight perimeter section having an offset rotable attachment to a locking dog, the locking dog having grasping pins extending from an opposing surface, the handle, the cam, the locking dog, and the grasping pins so arranged for the tool to provide a single installer to simultaneously straighten and install a board to a joist while maintaining a clearance between the board and the straightening tool for the installation of an edge-mount board fastener.

There has thus been outlined, rather broadly, the more important features of the invention in order that the following detailed description thereof may be better understood, and in order that the present contribution to the art may be better appreciated. Those skilled in the art will appreciate that the conception, upon which this disclosure is based, may readily be utilized as a basis for the design of other structures, methods and systems for carrying out the several purposes of the claimed invention. Still other benefits and advantages of this invention will become apparent to those skilled in the art upon reading and understanding the following detailed specification and related drawings. It is important, therefore, that the claims be regarded as including such equivalent constructions insofar as they do not depart from the spirit and scope of the claimed invention.

BRIEF DESCRIPTION OF THE DRAWINGS

In order that these and other objects, features, and advantages of the present invention may be more fully comprehended and appreciated, the invention will now be described, by way of example, with reference to specific embodiments thereof which are illustrated in appended drawings wherein like reference characters indicate like parts throughout the several figures. It should be understood that these drawings only depict preferred embodiments of the present invention and are not therefore to be considered limiting in scope, thus, the invention will be described and explained with additional specificity and detail through the use of the accompanying drawings, in which.

LIST OF REFERENCE NUMERALS AND THE PARTS TO WHICH THEY REFER

Figure 1:
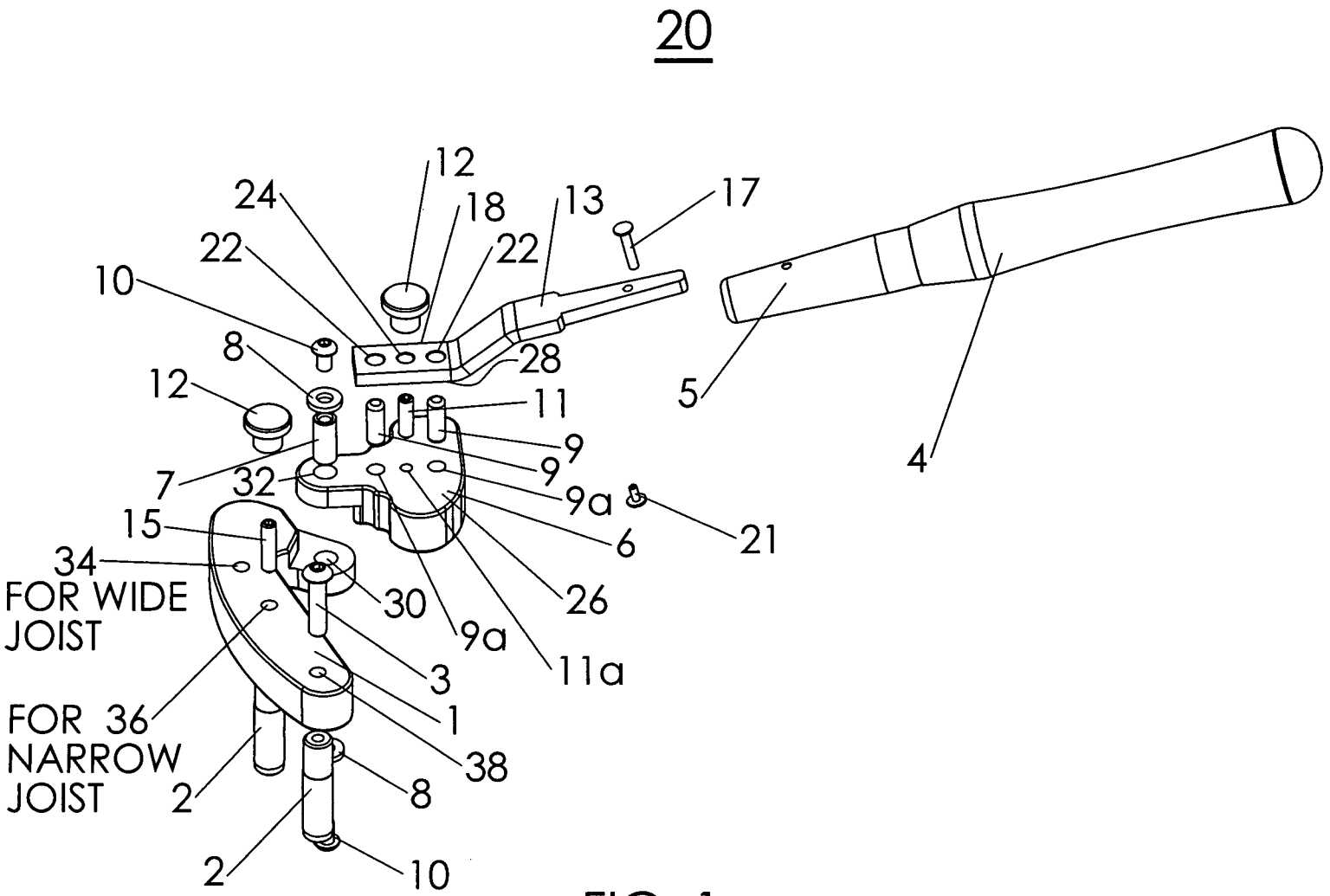
FIG. 1 is an exploded view of the present invention.

1 Locking dog.
2 Textured dowel pin locking fingers (grasping pins).
3 Button head screw.
4 Wooden handle.
5 Ferrule.
6 Cam.
7 Offset pivot pin.
8 Hardened washer.
9 Dowel pin.
9*a* Apertures accepting dowel pins 9.
10 Button head screw.
11 Threaded insert.
11*a* Aperture accepting threaded insert 11.
12 Threaded knob.
13 Handle adapter.
14 Floor boards.
15 Treaded insert.
16 Support studs (joists).
17 Binding post.
18 Handle adapter 13 tab extension with apertures 22 and 24.
19 Partially built deck floor.
20 Straightening tool.
21 Screw.
22 Apertures.
24 Aperture.
26 Surface of cam 6.
28 Surface of handle adapter 13.
30 Aperture.
32 Aperture.
34 Aperture.
36 Aperture.
38 Aperture.
40 Sliding slot into which locking fingers may be secured.
52 One rounded corner perimeter section of cam 6.
54 A straight perimeter section of cam 6.
56 A second curved perimeter section of cam 6.
60 A head or bow section of cam 6.
62 A truncated keyway from which extends head or bow section of cam 6.

It should be understood that the drawings are not necessarily to scale. In certain instances, details which are not necessary for an understanding of the present invention or which render other details difficult to perceive may have been omitted.

DETAILED DESCRIPTION

Referring now, with more particularity, to the drawings, it should be noted that the disclosed invention is disposed to embodiments in various sizes, shapes, and forms. Therefore, the embodiments described herein are provided with the understanding that the present disclosure is intended as illustrative and is not intended to limit the invention to the embodiments described herein.

Figure 6A:
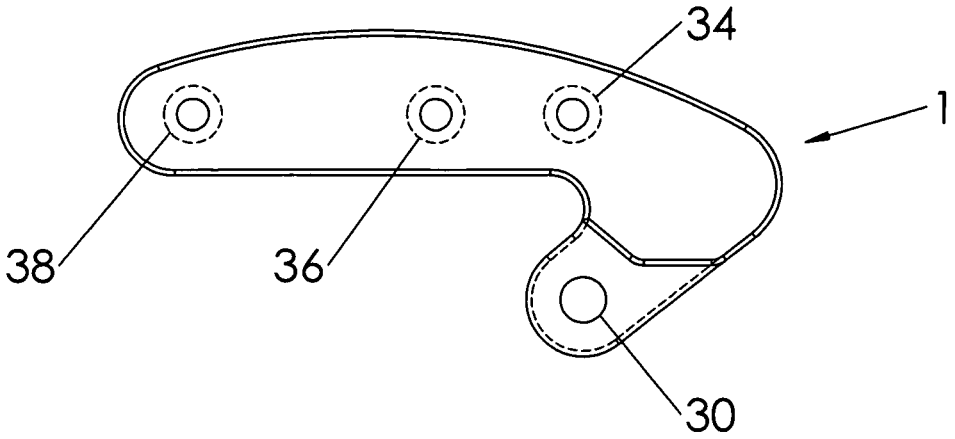
FIG. 6*a* is a plan view showing one style of locking dog construction of the present invention.
Figure 6B:
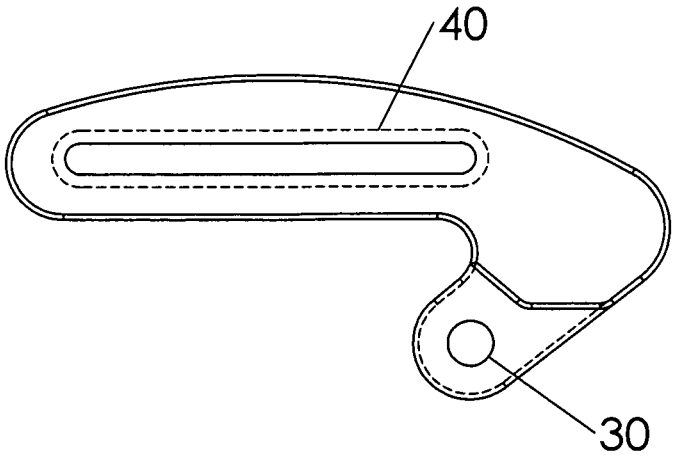
FIG. 6*b* is a plan view showing another style of locking dog construction of the present invention.

Turning now to the drawings, FIG. 1, an exploded view of an example of the present invention, illustrates one way to make straightening tool 20 according to the principles of the present invention. Ferrule 5 (a tang sleeve) on wooden handle 4 accepts one end of handle adapter 13 and forms a secure attachment therewith by inserting binding post 17 through a receiving aperture in ferrule 5 and then into a receiving aperture in handle adapter 13, and is held securely in place by screw 21. It is to be appreciated that there are many ways that this attachment may be made; for example, a rivet could be used in place of the screw and post method. Handle tab 18 extends from the second end handle adapter 13. Three apertures, two end apertures 22 and center aperture 24, extend through tab 18 of handle adapter 13. Three corresponding apertures, two spaced apertures 9*a* and one center aperture 11*a*, extend through cam 6. One end of each of dowel pins 9 and one end of center threaded insert 11 are each secured in the two end apertures 22 and center aperture 24, respectively, through surface 28 of tab 18. The opposing end of each of dowel pins 9 and center threaded insert 11 are secured in the two end apertures 9*a* and center aperture 11*a*, respectively, through surface 26 of cam 6. After threaded insert 11 has been accepted through aperture 24, threaded knob 12 is threaded onto threaded insert 11 to secure the handle to cam 6. Handle 4 is easily directionally reversed by unscrewing threaded knob 12, lifting handle tab 18 off of dowel pins 9, rotating handle tab 18 so that the handle extends in a diametrically opposed direction from that which it had, and screwing knob 12 back into place. Installation of the first board requires using the straightening tool handle in its reversed position; else the handle will interfere with the structure that extends above the board. Offset pivot pin 7 extends through aperture 32 of cam 6 into aperture 30 of locking dog 1 and is held securely in place by hardened washer 8 and button head screw 10. Offset pivot pin 7 rotatably secures locking dog 1 to cam 6 (see also FIG. 6*a*). Dowel pins 2 serve as "locking fingers" or grasping pins to grasp and lock onto either a narrow or wider joist. In the drawings of FIG. 1, two dowel pins 2 are shown. Stationary pin 2 is held in place in aperture 38 of locking dog 1 by button head screw 3 (see also FIG. 2). Moveable pin 2 may be detachably attached in aperture 36 of locking dog 1 by threaded insert 15 and threaded knob 12. In this position, locking fingers 2 are adjusted for grasping a narrow joist. When moveable pin 2 is moved from aperture 36 to aperture 34 and secured again by threaded insert 15 and threaded knob 12, locking fingers 2 are positioned for grasping and locking onto a wider joist. A series of spaced apertures (not shown) will accommodate joist of a variety of widths. It should be understood that many of the features of the present invention may be modified and still maintain the concept of the invention. For example, locking dog 1 and its locking fingers 2 may be formed so that the locking fingers are adjusted with respect to each other by being moved to various positions in a sliding slot 40, as illustrated in FIG. 6*b*, instead of one, or alternatively both, fingers being removed and repositioned on the locking dog. In this embodiment locking fingers 2 are constructed from dowel pins that have been knurled and/or textured to provide greater gripping force. The offset of pivot pin 7 with respect to both the locking dog and the cam provides the access required to install the locking finger dowel pins on the joist against which the straitening tool is to be braced. With locking fingers 2 stabilizing locking dog 1 about a joist and cam 6 wedged against the board that is to be simultaneously straightened and installed, pivotable offset pin 7 acts as the fulcrum to multiply the force that an installer applies to handle 4.

Figure 7A:
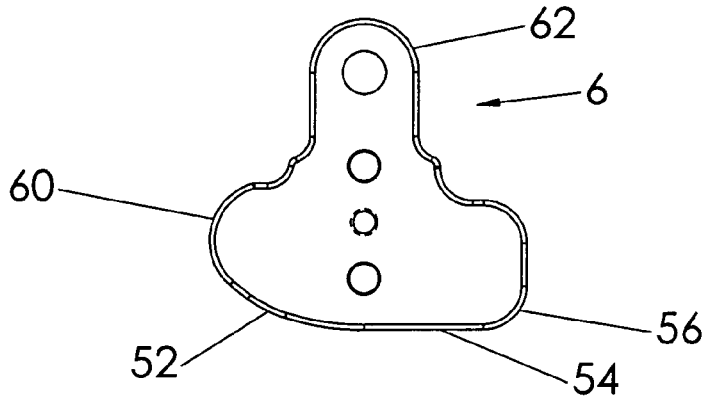
FIG. 7*a* is a plan view showing one style of cam construction of the present invention.
Figure 7B:
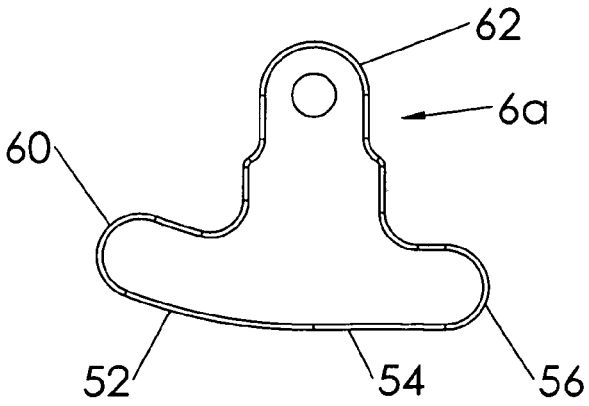
FIG. 7*b* is a plan view showing another style of cam construction of the present invention.
Figure 7C:
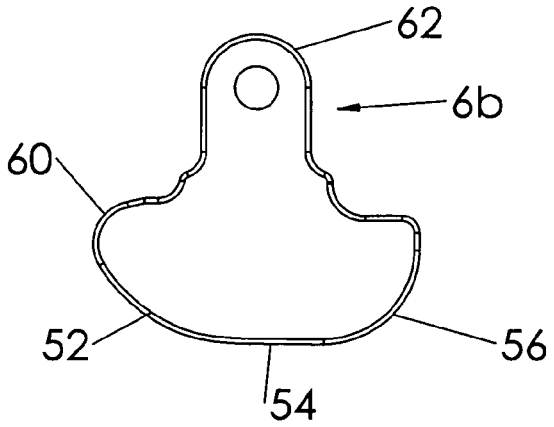
FIG. 7*c* is a plan view showing yet another style of cam construction of the present invention.
Figure 8A:
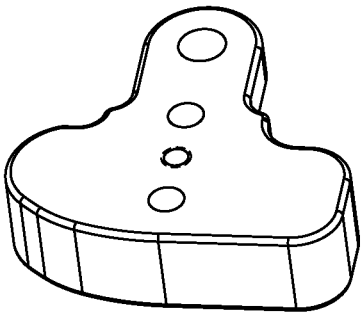
FIG. 8*a* is a perspective view illustrating how the stylized shape of the cam perimeter ensures that the sweet spot is not bypassed.
Figure 8B:
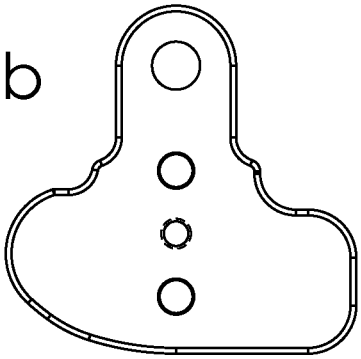
FIG. 8*b* is a plan view illustrating how the stylized shape of the cam perimeter ensures that the sweet spot is not bypassed.
Figure 9:
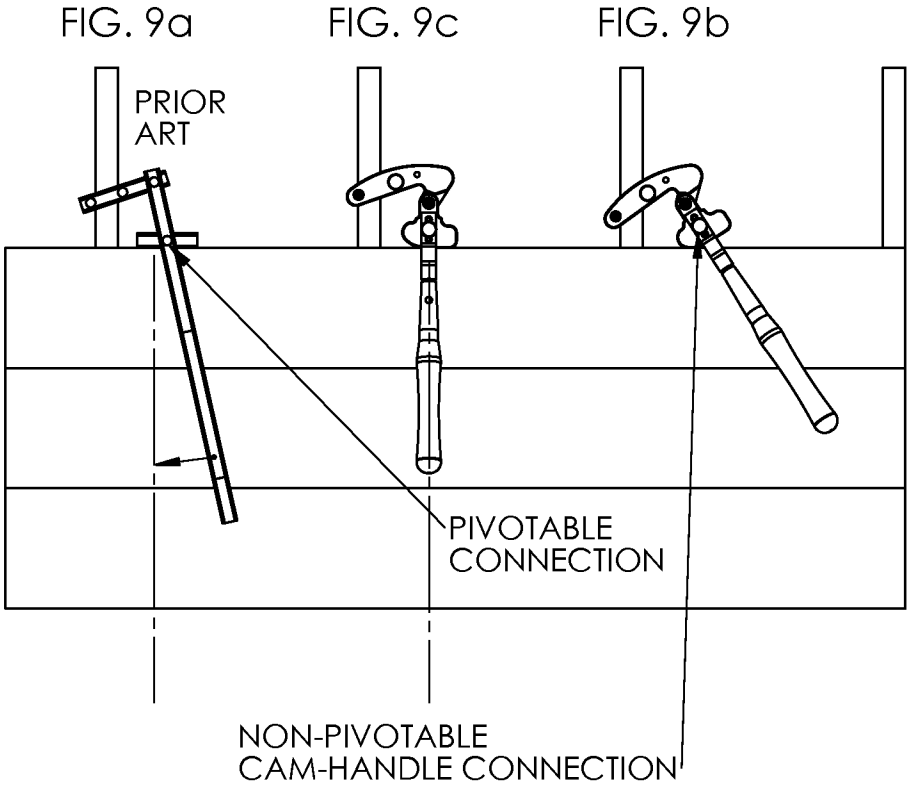
FIG. 9*a* is a plan view illustrating how the cam perimeter of currently available art ensures that the sweet spot can be bypassed.
FIG. 9*b* is a plan view illustrating where on the curved section of the cam's perimeter maximum compression begins.
FIG. 9*c* is a plan view illustrating how the straight section of the cam's perimeter that follows the curved section of the perimeter provides for the sweet spot to be reach and recognized, but not bypassed.

The cam of the present invention is offered in various shapes. As illustrated in FIGS. 7*a*, 7*b*, and 7*c*, the multi-radii perimeter edges of cams 6, 6*a*, and 6*b*, respectively, have different shapes, but each has a curved perimeter portion adjacent to a flat perimeter portion to provide the additional force required to straighten a greater amount of crown of each board than heretofore possible. FIG. 7*a* illustrates the shape of the cam as illustrated in FIG. 1, and may be described as being somewhat similar to the shape of a household key having head or bow 60 from which extends truncated keyway 62. The part of the cam that mimics the key bow includes rounded corner perimeter section 52, the curve of which provides for additional force to be applied at the point of maximum force (the "sweet spot") required for board straightening. Followed by, and adjacent to the one rounded perimeter, there is straight perimeter section 54 for keeping the tool from slipping past the sweet spot, and adjacent to and following the straight perimeter section there is second curved perimeter section 56. As explained just above, rounded perimeter section 52 increases the holding force of the tool when the tool is attached to a joist and straight edged perimeter section 54 acts as a brake to reduce chances of the tool slipping off of the joist, which is a frequent occurring problem with currently available board straightening devices. The tool would likely slip off of the joist if the handle, which is being used as a fulcrum, were able to turn the cam so that the cam would slip by its "sweet spot", which is the point where the handle has positioned the cam's edge for the tool to apply the maximum lateral force to the board it is straightening. Also, when the sweet spot is missed by the presently available devices, the board springs back into its bent position, causing the user to have to reposition the tool in a slightly different distance from the deck board and try again. This trial and error must be repeated until the proper alignment position is found. The tool, as taught herein, eliminates the need for these often multiple attempts to locate the right distance from the board being pushed due mostly to the unique design of the cam's perimeter. The likely occurrence of slippage of presently available straightening tools limits the tools straightening force and reduces the pushing distance, thus limiting the amount of bow that can be removed from a board. The device of the present invention removes a much higher degree of bow from a board as it maximizes the mechanical pushing distance. FIGS. 7*b* and 7*c* illustrate two of the many similar, but different, shapes that may be used to achieve one objective of the invention, which is to be able to find, and lock into, the point of greatest force of the cam against the board being straightened. Available devices often can not apply the force necessary to fully straighten the board being installed because there is no way for an installer to ascertain when the sweet spot has been reached and either under-applies force or goes past the point of the application of greatest force. In either case, the board starts to bow again and the installer must continuously move the handle back and forth to find the spot of maximum lateral force (the sweet spot.) Such repetitive movement of the handle results in boards that are not fully straightened. The partly curved, partly straight perimeter design of the cam of the present invention eliminates the problems of currently available tools (see FIGS. 8*a* and 8*b* for additional illustration of the design principles). As explained above and as illustrated in FIG. 9*b*, the curved section of the cam (such as rounded corner perimeter section 52 of cam 6, as illustrated in FIG. 7), provides for the cam to be rotated about the curve of section 52 as the installer applies force to the handle until the point of maximum compression of the tool against the board being installed, and simultaneously straightened, is reached (the sweet spot) as indicated by the vertical dashed line, thus, bringing straight reach 54 of the cam adjacent, parallel, and in contact with the board (See FIG. 9*c*) to lock the handle in place to keep the tool from slipping past the sweet spot. The principles of the present invention make this possible because the cam is fixed to the handle, that is, the cam is not rotate-able with respect to the handle. A presently available design has a cam that has a straight perimeter edge but cannot lock the tool in the sweet spot position because of the rotability of the handle about the cam/handle connection providing for the handle to be pushed past the point of maximum compression (the sweet spot), as can be understood by the illustration of FIG. 9*a*. To force a board straight using a presently available tool, as illustrated in FIG. 9*a* the handle of the tool is pushed in the direction shown by the arrow. If the handle is pushed past the dashed vertical line it looses its pushing force and the board pushes back. The handle must then be pushed back to find the tool's maximum holding spot, but not too much or the tool will slip. The design of the perimeter of the cam combined with the locking fingers and the elongated locking dog provides the grabbing force required to keep the tool from sliding back on the joist, thus, providing maximum straightening force to each board.

Figure 2:
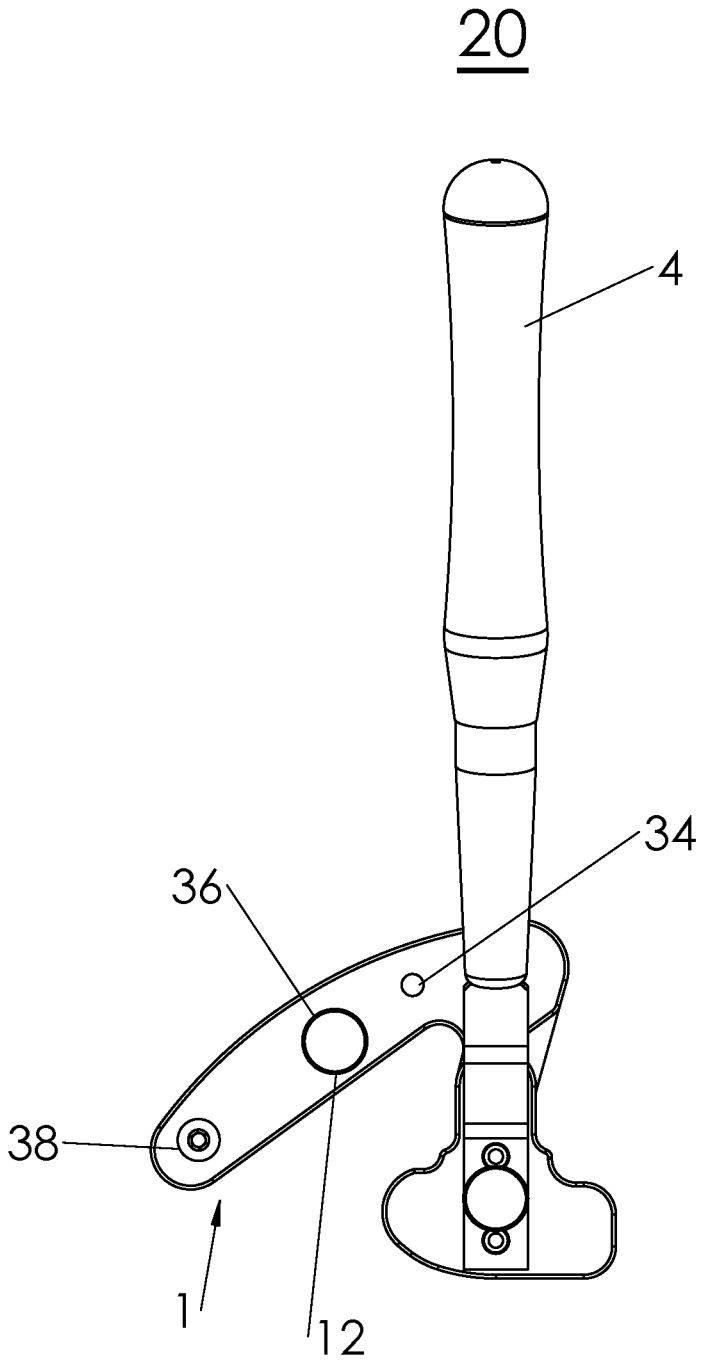
FIG. 2 is a plan view of the fully assembled invention, as shown in FIG. 1.
Figure 3:
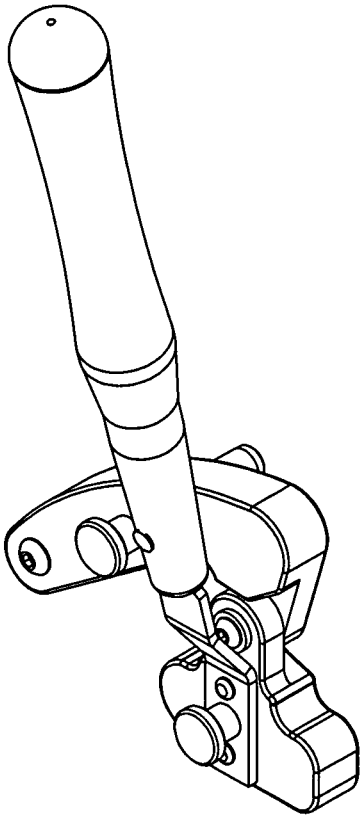
FIG. 3 is a perspective view of the fully assembled invention, as shown in FIG. 2, to show the handle extending over the cam section of the tool.

FIG. 2, a plan view, and FIG. 3, a perspective view, illustrate fully assembled tool 20 with handle 4 extending over cam 6.

Figure 4:
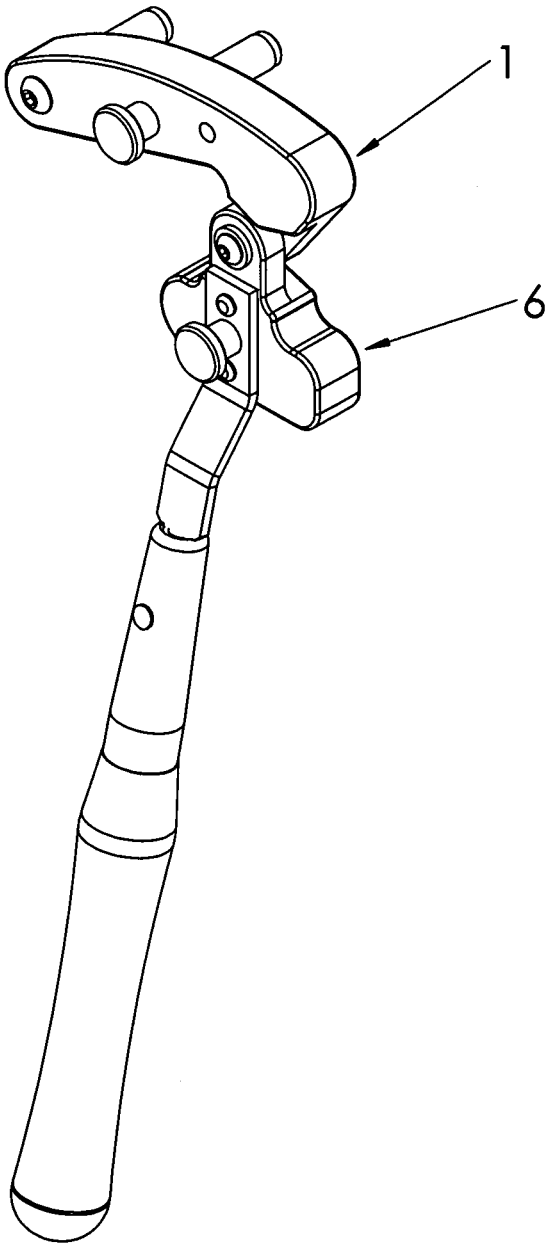
FIG. 4 is a perspective view to show the handle extending away from the cam section of the tool.

FIG. 4, a perspective view, illustrates fully assembled tool 20 with handle 4 positioned to extend away from cam 6 to provide for handle to be rotated a full 180° so that the tool can be used on the first starter board of the deck without the handle hitting the wall. The ability to position the tool handle at 0 degrees and at 180 degrees is within the capability of the embodiment illustrated herein, however alternative embodiments of the device incorporate multi-positioning points of the handle at various degree settings. Other devices attempt to overcome the problem of the prying handle hitting the wall by reversing the handle's position in a such a fashion that the physics of the pivot points of the lever are altered, resulting in a reduction of the force applied to the deck board when used in the reverse handle position, and/or off balances the tool causing it to be awkward to the user attempting to straighten the deck board. The unique design following the principles of the present invention provides for the handle to be reversed and still achieve maximum force and without making the tool clumsy and awkward to use in practice.

Figure 5:
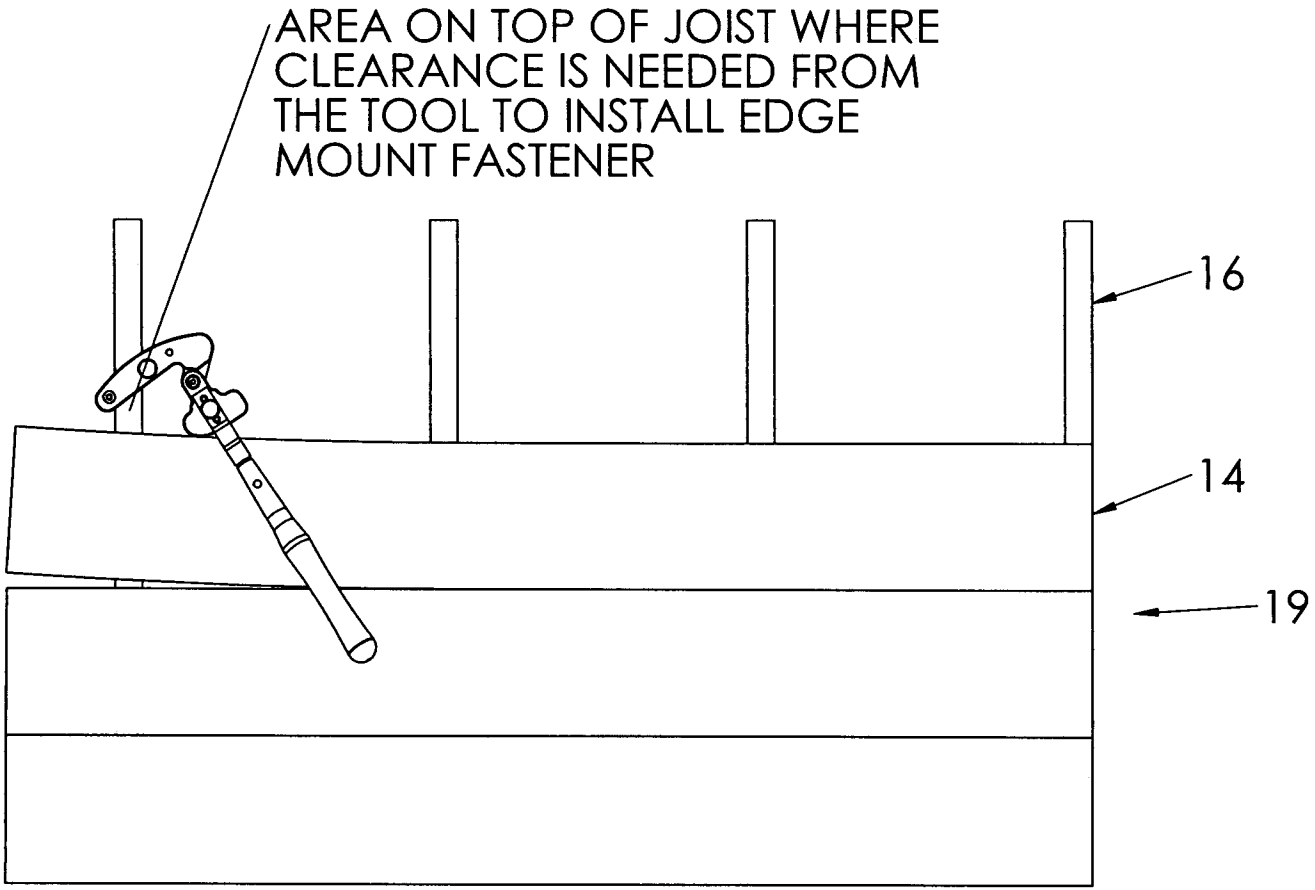
FIG. 5 is a plan view showing the tool of the present invention is use.
Figure 10:
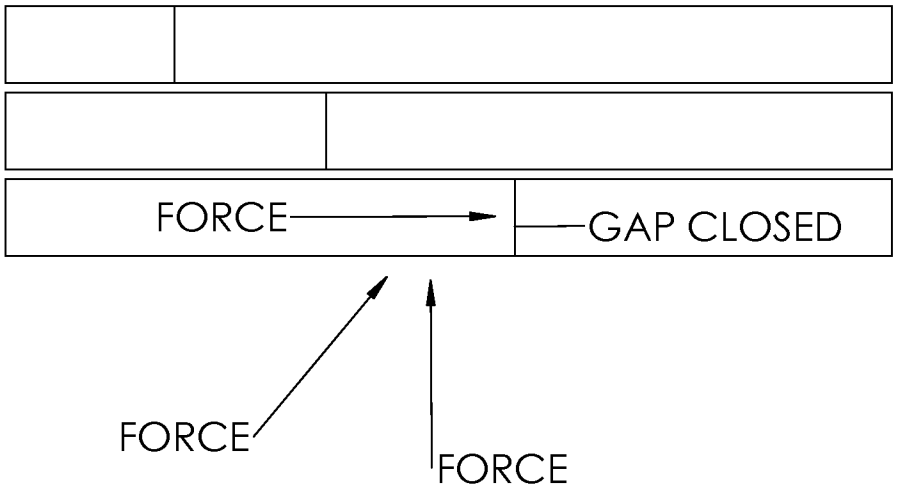
FIG. 10 is a plan view illustrating the directional aspects of the force that the straightening tool applies to a deck board.

FIG. 5 is a plan view showing the tool of the present invention being used, during the installation of deck floor 12, to straighten and simultaneously position floor boards 14 for attachment to support studs (joists) 16. The cam design of the present invention reduces chances of marring the board edge it is straightening and allows for the cam and the locking fingers of the tool to be locked in place providing for the installer's hands to remain free while the device is in use. Additionally, the specially designed shape of the cam of the present invention provides the clearance required for the installation of edge-mount fasteners on the same joist the tool's fingers are grasping. Other deck straightening devices do not allow any, or allow inadequate room, for installing an edge-mount fastener while the board is being held straight by a tool. This is an important consideration as edge-mount fasteners are becoming increasingly popular. Current board straightening devices are not able to provide the force required for a tool to fully straighten overly crooked boards, and/or do not have enough "throw" distance to take out a large bend in the board in a single swing of the handle. In instances where the wood is delicate and easily marred, the surface of the joist grabbing (locking) pins of the present tool are smooth. Alternatively, where the finish of the joists is not of concern and where extra pushing force against the deck boards to be straightened is desired, the smooth surface of the joist grabbing (locking) pins may use machine knurled or rough-shaped pins. Moreover, a straightening tool, made according to the principles as taught herein, applies force to the board being straightened in both perpendicular and angular directions which provides not only for straightening the board, but also for assuring that the abutting ends of the deck boards are positioned as closely as possible to each other (see FIG. 10).

The foregoing description, for purposes of explanation, uses specific and defined nomenclature to provide a thorough understanding of the invention. However, it will be apparent to one skilled in the art that the specific details are not required in order to practice the invention. Thus, the foregoing description of the specific embodiment is presented for purposes of illustration and description and is not intended to be exhaustive or to limit the invention to the precise form disclosed. Those skilled in the art will recognize that many changes may be made to the features, embodiments, and methods of making the embodiments of the invention described herein without departing from the spirit and scope of the invention. Furthermore, the present invention is not limited to the described methods, embodiments, features or combinations of features but include all the variation, methods, modifications, and combinations of features within the scope of the appended claims. The invention is limited only by the claims.

What is claimed is:

1. A board straightening tool, comprising:

a single handle, a cam having a curved perimeter portion adjacent a straight perimeter portion, a locking dog having grasping pins, each in having a length greater than its diameter and perpendicular to said handle, cam, and locking dog, and a pivot pin, said handle non-rotatably attachable to cam for movement together and for direct transfer of force applied to the handle to said cam that transfers the force directly to a board being straightened, said cam pivotably couple-able to said locking dog in an offset manner and to be in direct communication with a board to be straightened, and said grasping pins arranged for the length of each of said pins to be positioned parallel to an opposing side of a joist, so that when: (1) said handle is non-rotatably attached to said cam, (2) said cam is pivotably coupled in an offset manner to said locking dog by said pivot pin, and (3) said tool is positioned so that said grasping pins are each positioned on an opposing side of the joist and, (4) said cam is tightly wedged directly against the board to be straightened, then when force is applied to said handle and thus directly to said cam, said pivot in acts as a fulcrum to multiply the force applied to the handle and the compression-force of the grasping pins against the joist, and maintain a maximum force to the board being straightened, while a clearance between the board and the straightening tool for insertion of an edge-mount board fastener can be maintained providing for a single installer to simultaneously straighten and install a board to a joist.

2. The straightening tool, as recited in claim 1, further comprising said handle detachably attached to said cam.

3. The straightening tool, as recited in claim 2, wherein said handle is able to be detached and reattached in a non-rotatable attachment to be used in 180 degree directionally opposition positions.

4. The board straightening tool, as recited in claim 1, wherein said handle is adjustable to be positioned for use in multiple varying degrees from the tool body.

5. The straightening tool, as recited in claim 1, wherein said grasping pins can be positionably adjusted to grasp varying joist sizes.

6. The straightening tool, as recited in claim 5, wherein said grasping pins can grasp a joist stabilizing said locking dog so that when said curved perimeter portion of said cam is wedged against the board said offset rotable attachment acts as a fulcrum to multiply the force that an installer applies to said handle.

7. The straightening tool, as recited in claim 1, wherein said grasping pins are constructed from a knurled metal.

8. The straightening tool, as recited in claim 1, wherein said pins are constructed having a smooth surface providing for a reduction of marring of the joist.

9. The straightening tool, as recited in claim 1, wherein the structure of said cam rotatably attached to said locking dog by a pivot pin offset with respect to both and the cam provides the access required to install the locking finger dowel pins on the joist against which the straightening tool is to be braced.

10. The straightening tool, as recited in claim 9, wherein when said grasping fingers are stabilizing said locking dog about a joist and said cam is wedged against the board that is to be simultaneously straightened and attached to the joist said pivotable offset pin provides the function of a fulcrum to multiply the force that an installer applies to said handle.

11. A board straightening tool comprising a single handle non-rotatably attached to a cam, said cam having a perimeter comprising a plurality of arcs and a straight portion, said cam rotatably attached to a locking dog, said locking dog having opposing compression grasping pins each having a length equal to or greater than its diameter, said handle, said cam, said locking dog, and said grasping pins arranged so as to increase the offset opposing compression of the pins against a joist in reaction to the cam applying a force directly to a board to be straightened and fixed to the joist allowing for maximum holding pressure and a reduction of slippage of the tool on the joist.

12. A straightening tool, comprising:

a single handle detachably attached to a cam for movement together, said cam pivotably coupled to a locking dog, said cam having a curved perimeter portion adjacent a straight perimeter portion, said locking dog having grasping pins arranged to grasp a joist in reaction to the cam applying a force directly to a board to be straightened, said handle, said cam, said locking dog, and said grasping pins arranged such that there is a clearance between the board and said tool for receiving an edge-mount board fastener.

13. A board-straightening tool comprising a single handle, a locking dog and a cam, said cam having a curved perimeter portion and a straight perimeter portion, the handle and the cam being coupled to each other for movement together, and pivotably coupled to the locking dog for pivotal movement together relative thereto; the locking dog having grasping pins arranged to grasp a joist there between in reaction to the cam applying a force directly to a board to be straightened and fixed to the joist; wherein the cam and handle are arranged such that rotation of the handle relative to the locking dog rotates the cam relative to the locking dog to vary the distance between a perimeter surface of the cam and the center of rotation, and thereby vary the force applied to the board to be straightened.

14. A tool according to claim 13, wherein the perimeter surface of the cam comprises a curved portion adjacent to a flat portion.

15. A tool according to claim 14, wherein the flat portion is adjacent a part of the curved portion that is further from the centre point of the pivotable movement than other parts of the curved portion.

16. A tool according to claim 13, wherein the perimeter surface of the cam comprises two curved portions and one flat portion, the flat portion being between the two curved portions.

17. A tool according to claim 14, wherein the perimeter surface of the cam comprises two curved portions and one flat portion, the flat portion being between the two curved portions.

18. A tool according to claim 15, wherein the perimeter surface of the cam comprises two curved portions and one flat portion, the flat portion being between the two curved portions.

19. A tool according to claim 16, wherein the flat portion is adjacent a part of each of the curved portions that is further from the centre point of the pivotable movement than other parts of the respective curved portion.

20. A tool according to claim 19, wherein each curved portion is of varying radius, the radius adjacent the flat portion being larger than that away from the flat portion.

21. A tool according claim 18, wherein each curved portion is of varying radius, the radius adjacent the flat portion being larger than that away from the flat portion.

22. A tool according to claim 16, wherein each curved portion is of varying radius, the radius adjacent the flat portion being larger than that away from the flat portion.

23. A tool according to claim 13, wherein at least one of the grasping pins is selectively positionable to vary the distance between the locking fingers so as to accommodate joists of different thickness.

24. A tool according to claim 23, wherein the at least one of the grasping pins is selectively positionable by being removeably positionable in each of a plurality of apertures in the locking dog.

25. A tool according to claim 23, wherein the at least one of the grasping pins is selectively positionable at various positions in a slot in the locking dog.

26. A tool according to claim 13, wherein the handle and the cam are releasably coupled to each other and can be coupled to each other in each of at least two relative orientations.

27. A tool according to claim 26, wherein a first one of the at least two orientations comprises the handle and the cam being on the same side of the centre of the pivotable movement, and a second one of the at least two orientations comprises the handle and the cam being on opposite sides of the centre of the pivotable movement.

28. A tool according to claim 26, wherein, in the first one of the at least two orientations, the handle and the cam are substantially aligned such that the handle extends from the centre of the pivotable movement in a first direction and the cam is spaced from the centre of pivotable movement in that first direction; and, in the second one of the at least two orientations, the handle extends from the centre of the pivotable movement in a second direction and the cam is spaced from the centre of the pivotable movement is a direction substantially opposite to that second direction.

29. A tool according to claim 13, wherein the fingers are arranged on the locking dog to one side of the point of pivotable movement and spaced therefrom such that the cam is spaced from the joist in use.

30. A board-straightening tool comprising a single handle, a locking dog and a cam wherein the perimeter of the cam comprises a curved portion and a flat portion; the handle and the cam being coupled to each other for movement together, and pivotably coupled to the locking dog for pivotable movement together relative thereto; the locking dog having grasping pins arranged to grasp a joist there between in reaction to the cam applying a force directly to a board to be straightened and fixed to the joist; wherein at least one of the grasping pins is selectively positionable to vary the distance between the locking fingers so as to accommodate joists of different thickness.

31. A board-straightening tool comprising a single handle, a locking dog and a cam wherein the perimeter of the cam comprises a curved portion adjacent to a flat portion; the handle and the cam being coupled to each other for movement together, and pivotably coupled to the locking dog for pivotable movement together relative thereto; the locking dog having grasping pins arranged to grasp a joist there between in reaction to the cam applying a force directly to a board to be straightened and fixed to the joist; wherein the handle and the cam are releasably coupled to each other and can be coupled to each other in each of at least two relative orientations.

32. A board-straightening tool comprising a single handle, a locking dog and a cam wherein the perimeter of the cam comprises a curved portion and a flat portion; the handle and the cam being coupled to each other for movement together, and pivotably coupled to the locking dog for pivotable movement together relative thereto; the locking dog having grasping pins arranged to grasp a joist there between in reaction to the cam applying a force directly to a board to be straightened and fixed to the joist; wherein the grasping pins are both arranged on the locking dog to one side of the point of pivotable movement and spaced therefrom such that the cam is spaced from the joist in use.

33. A board-straightening tool comprising a single handle, a locking dog and a cam wherein the perimeter of the cam comprises a curved portion and a flat portion; the handle and the cam being coupled to each other for movement together, and pivotably coupled to the locking dog for pivotable movement together relative thereto; the locking dog having grasping pins arranged to grasp a joist there between in reaction to the cam applying a force directly to a board to be straightened and fixed to the joist; wherein at least one of the grasping pins is selectively positionable to vary the distance between the locking fingers so as to accommodate joists of different thickness.

34. A tool according to claim 33 wherein the at least one of the grasping pins is selectively positionable by being removeably positionable in each of a plurality of apertures in the locking dog.

35. A tool according to claim 33, wherein the at least one of the grasping pins is selectively positionable at various positions in a slot in the locking dog.

36. A tool according to claim 33, wherein the handle and the cam are releasably coupled to each other and can be coupled to each other in each of at least two relative orientations.

37. A tool according to claim 33, wherein the grasping pins are both arranged on the locking dog to one side of the centre of the pivotable movement and spaced therefrom such that the cam is spaced from the joist in use.

38. A board-straightening tool comprising a handle, a locking dog and a cam wherein the perimeter of the cam comprises a curved portion and a flat portion; the handle and the cam being coupled to each other for movement together, and pivotably coupled to the locking dog for pivotable movement together relative thereto; the locking dog having grasping pins arranged to grasp a joist there between in reaction to the cam applying a force directly to a board to be straightened and fixed to the joist; wherein the handle and the cam are releasably coupled to each other and can be coupled to each other in each of at least two relative orientations.

39. A tool according to claim 38, wherein a first one of the at least two orientations comprises the handle and the cam being on the same side of the centre of the pivotable movement, and a second one of the at least two orientations comprises the handle and the cam being on opposite sides of the centre of the pivotable movement.

40. A tool according to claim 38, wherein, in the first one of the at least two orientations, the handle and the cam are substantially aligned such that the handle extends from the centre of the pivotable movement in a first direction and the cam is spaced from the centre of pivotable movement in that first direction; and, in the second one of the at least two orientations, the handle extends from the centre of the pivotable movement in a second direction and the cam is spaced from the centre of the pivotable movement is a direction substantially opposite to that second direction.

41. A board-straightening tool comprising a single handle, a locking dog and a cam wherein the perimeter of the cam comprises a curved portion and a flat portion; the handle and the cam being coupled to each other for movement together, and pivotably coupled to the locking dog for pivotable movement together relative thereto; the locking dog having grasping pins arranged to grasp a joist there between in reaction to the cam applying a force directly to a board to be straightened and fixed to the joist; wherein the grasping pins are both arranged on the locking dog to one side of the point of pivotable movement and spaced therefrom such that the cam is spaced from the joist in use.

42. A board-straightening tool comprising a single handle, a locking dog and a cam wherein the perimeter of the cam comprises a curved portion and a flat portion; the handle and the cam being coupled to each other for movement together, and pivotably coupled to the locking dog for pivotable movement together relative thereto; the locking dog having grasping pins arranged to grasp a joist there between in reaction to the cam applying a force directly to a board to be straightened and fixed to the joist; wherein the cam and handle are arranged such that rotation of the handle relative to the locking dog rotates the cam relative to the locking dog to vary the distance between a perimeter surface of the cam and the centre of rotation, and thereby vary the force applied to the board to be straightened.

43. A tool according to claim 42, wherein the perimeter surface of the cam comprises a curved portion adjacent a flat portion.

44. A tool according to claim 42, wherein the flat portion is adjacent a part of the curved portion that is further from the centre point of the pivotable movement than other parts of the curved portion.

45. A tool according to claim 43, wherein the flat portion is adjacent a part of the curved portion that is further from the centre point of the pivotable movement than other parts of the curved portion.

46. A tool according to claim 42, wherein the perimeter surface of the cam comprises two curved portions and one flat portion, the flat portion being between the two curved portions.

47. A tool according to claim 43, wherein the perimeter surface of the cam comprises two curved portions and one flat portion, the flat portion being between the two curved portions.

48. A tool according to claim 44, wherein the perimeter surface of the cam comprises two curved portions and one flat portion, the flat portion being between the two curved portions.

49. A tool according to claim 45, wherein the perimeter surface of the cam comprises two curved portions and one flat portion, the flat portion being between the two curved portions.

50. A tool according to claim 46, wherein the flat portion is adjacent a part of each of the curved portions that is further from the centre point of the pivotable movement than other parts of the respective curved portion.

51. A tool according to claim 47, wherein the flat portion is adjacent a part of each of the curved portions that is further from the centre point of the pivotable movement than other parts of the respective curved portion.

52. A tool according to claim 48, wherein the flat portion is adjacent a part of each of the curved portions that is further from the centre point of the pivotable movement than other parts of the respective curved portion.

53. A tool according to claim 49, wherein the flat portion is adjacent a part of each of the curved portions that is further from the centre point of the pivotable movement than other parts of the respective curved portion.

54. A tool according to claim 43, wherein the curved portion is of varying radius, the radius adjacent the flat portion being larger than that away from the flat portion.

55. A tool according to claim 44, wherein the curved portion is of varying radius, the radius adjacent the flat portion being larger than that away from the flat portion.

56. A tool according to claim 45, wherein the curved portion is of varying radius, the radius adjacent the flat portion being larger than that away from the flat portion.

57. A tool according to claim 46, wherein one or each curved portion is of varying radius, the radius adjacent the flat portion being larger than that away from the flat portion.

58. A tool according to claim 47, wherein one or each curved portion is of varying radius, the radius adjacent the flat portion being larger than that away from the flat portion.

59. A tool according to claim 48, wherein one or each curved portion is of varying radius, the radius adjacent the flat portion being larger than that away from the flat portion.

60. A tool according to claim 49, wherein one or each curved portion is of varying radius, the radius adjacent the flat portion being larger than that away from the flat portion.

61. A tool according to claim 50, wherein the or each curved portion is of varying radius, the radius adjacent the flat portion being larger than that away from the flat portion.

62. A tool according to claim 51, wherein each curved portion is of varying radius, the radius adjacent the flat portion being larger than that away from the flat portion.

63. A tool according to claim 52, wherein the or each curved portion is of varying radius, the radius adjacent the flat portion being larger than that away from the flat portion.

64. A tool according to claim 53, wherein the or each curved portion is of varying radius, the radius adjacent the flat portion being larger than that away from the flat portion.

* * * * *

UNITED STATES PATENT AND TRADEMARK OFFICE

CERTIFICATE OF CORRECTION

PATENT NO. : 8,936,054 B2
APPLICATION NO. : 12/687373
DATED : January 20, 2015
INVENTOR(S) : Robert J. Pelc, Jr.

It is certified that error appears in the above-identified patent and that said Letters Patent is hereby corrected as shown below:

In the Claims

Under Column Number 10, Claim Number 1: line 26, the word "in" after the word "each" should read -- pin --.

Under Column Number 10, Claim Number 1: line 47, the word "in" after the word "pivot" should read -- pin --.

Under Column Number 12, Claim Number 28: line 55, the word "is" after the word "movement" should read -- in --.

Under Column Number 14, Claim Number 40: line 16, the word "is" after the word "movement" should read -- in --.

Signed and Sealed this
Fifth Day of May, 2015

Michelle K. Lee

Michelle K. Lee
*Director of the United States Patent and Trademark Office*